US005695271A

United States Patent [19]

Zeller

[11] Patent Number: 5,695,271

[45] Date of Patent: Dec. 9, 1997

[54] TELESCOPING BOOKLIGHT

[76] Inventor: Noel E. Zeller, 630 S. Columbus Ave., Mount Vernon, N.Y. 10551-4445

[21] Appl. No.: 660,916

[22] Filed: Jun. 10, 1996

[51] Int. Cl.[6] ..... A47B 19/00

[52] U.S. Cl. ..... 362/98; 362/99; 362/191; 362/396; 362/413; 362/427

[58] Field of Search ..... 362/98, 99, 191, 362/396, 413, 414, 394, 395, 426, 427

[56] References Cited

U.S. PATENT DOCUMENTS

| | | | |
|---|---|---|---|
| D. 271,526 | 11/1983 | Zeller | D26/60 |
| 1,010,335 | 11/1911 | Williams . | |
| 1,854,302 | 4/1932 | Hansen . | |
| 2,261,872 | 11/1941 | Choate | 106/110 |
| 2,561,744 | 7/1951 | Langdon et al. | 240/6.4 |
| 3,066,219 | 11/1962 | Duddy | 240/47 |
| 4,432,042 | 2/1984 | Zeller | 362/183 |
| 4,581,684 | 4/1986 | Mazzucco | 362/98 |
| 4,680,681 | 7/1987 | Fisherman et al. | 362/98 |
| 5,180,220 | 1/1993 | Kalsbeek | 362/396 X |
| 5,280,416 | 1/1994 | Hartley et al. | 362/191 X |
| 5,442,528 | 8/1995 | Vandenbelt | 362/98 |

*Primary Examiner*—Stephen F. Husar

[57] ABSTRACT

A booklight includes a mounting bracket for mounting the booklight on a support, and an elongate first arm having a proximal end and a distal end, the proximal end being pivotally attached to the mounting bracket. A rigid elongate retractable arm has a proximal end and a distal end, the proximal end of the elongate retractable arm being telescopically connected to the distal end of the elongate first arm. The elongate first arm and elongate retractable arm are shaped so as to prevent rotation of the elongate retractable arm relative to the elongate first arm. The elongate retractable arm is mounted for movement with respect to the elongate first arm between a retracted position and an extended position. A light-radiating source is mounted at the distal end of the elongate retractable arm.

14 Claims, 7 Drawing Sheets

TELESCOPING BOOKLIGHT

BACKGROUND OF THE INVENTION

1. Field of the Invention

The present invention relates to booklights in general and, more particularly, to telescoping booklights.

2. Description of the Related Art

Booklights have been known for many years and are typically used for reading in bed, while traveling, etc. Booklights come in various shapes and forms and can be supported by an object to be illuminated (e.g., a book) in various ways.

A portable booklight by the inventor of the present invention is described and shown in U.S. Pat. Nos. 4,432,042 and Des. 271,526. The booklight includes a base supporting a vertical lamp-bearing arm and in integral clamp consisting of a U-shaped frame having side arms rigidly attached to the base. A central plate is flexibly attached to the base so that the entire book light may be attached to a book or other publication by inserting the cover or pages between the arms and the central plate.

A variation of the above-described book light is described in U.S. Pat. No. 5,180,220 and relates to a stitchery light-base and clamp. The stitchery light includes an arm for supporting a lamp and a base member for supporting the arm on a stitchery implement. The base member includes a clamping member arranged to adjustably mount on a stitchery implement.

An example of an electrical pocket writing and reading lamp is described in U.S. Pat. No. 2,161,872. The lamp includes a battery casing to which a wing of thin sheet metal is attached. The wing is formed to clamp to a book or pad. A lamp is attached to one end of a rigid or flexible arm. The other end of the arm is pivotally attached at one end of the battery casing. When the arm is swung into its opened position, an electrical contact is made enabling the lamp to light. When the arm is in its closed position, the electrical contact is broken and the lamp is disabled from lighting.

Another booklight is described in U.S. Pat. No. 2,561,744. The booklight includes a battery casing to which spring clips are attached. The clips are engageable over the top margins of the open covers of a book to support the booklight and to hold the book in an open position. A lamp is attached to one end of an arm, the other end of which is pivotally mounted to the battery casing. When the arm is rotated to an outwardly extending position, the lamp is energized. When the arm is rotated to its closed position, the lamp is deenergized.

Although capable of folding, the size to which the above-described devices can be folded down is limited by the length of the longest arm to which the lamp is attached. Limiting the length of the longest arm to minimize the overall size of the folded booklight tends to reduce the utility and effectiveness of the lamp in illuminating the pages of the book.

Various types of lamps having telescoping arms are well known and are described, for example, in U.S. Pat. Nos. 1,010,335, 1,854,302 and 3,066,219. Such telescoping arms allow the lamp arm to be placed in an extended position and in a compact retracted position. However, although such telescoping devices allow the arm to be placed in a compact position, since the arms described in these patents are circular in cross section, they tend to rotate with respect to each other when subjected to vibration or other movement. Accordingly, if such telescoping lamp arms are provided on a booklight type of device, which by its very nature is designed to be subjected to vibration and movement, the resulting movement or rotation of the lamp can prove annoying and distracting to the user. Although clamping devices such as screw clamps can be provided for preventing the arm segments from moving with respect to each other, this adds to the overall cost, complexity and size of the device.

Another type of booklight is described in U.S. Pat. No. 5,442,528. The device is a lighted bookmark which can be placed between the pages of a book and functions as a portable booklight while reading. A light-bearing neck of the bookmark can be retracted to fit within the body of the bookmark and can be extended out of the bookmark, causing the light to automatically energize. The neck possesses a memory effect that returns the neck to its original curved position when extended. The lamp is attached to the neck by a pivot which allows the lamp to be moved slightly in the up and down directions. However, such a booklight suffers from several drawbacks. For example, when the neck is in the extended position, since it must be flexible enough to assume its original curved position, the arm and light tend to be unstable. That is, when subjected to vibration or movement the lamp and neck tend to wobble and move, which is distracting to a reader of the book being illuminated. In addition, although the lamp can be pivoted slightly up and down, the lamp cannot be pivoted left or right. Accordingly, if the bookmark is placed on the left-hand side of the book, illumination to the right-hand side of the book is limited.

SUMMARY OF THE INVENTION

An object of the present invention is to overcome the problems associated with the above-noted devices. In particular, an object of the present invention is to provide a telescoping booklight that is more versatile and easier to use than any booklight known before.

Another object of the present invention is to provide a telescoping booklight that can be made more compact than any booklight known before.

Still another object of the present invention is to provide a telescoping booklight in which the telescoping arms do not rotate with respect to each other and which does not require clamps or other securing means for preventing rotation of one arm with respect to the other arm or arms.

The present invention relates to a booklight including a mounting bracket for mounting the booklight on a support. An elongate first arm has a proximal end and a distal end. The proximal end of the elongate first arm is pivotally attached to the mounting bracket. A rigid elongate retractable arm has a proximal end and a distal end. The proximal end of the elongate retractable arm is telescopically connected to the distal end of the elongate first arm. The elongate first arm and elongate retractable arm are shaped so as to prevent rotation of the elongate retractable arm relative to the elongate first arm. The elongate retractable arm is mounted for movement with respect to the elongate first arm between a retracted position and an extended position. A light-radiating source is mounted at the distal end of the elongate retractable arm. The booklight can also include a switch to turn the light-radiating source on to radiate light in response to movement of the elongate retractable arm to the extended position and to turn off the light-radiating source in response to movement of the elongate retractable arm to the retracted position.

The present invention also relates to a booklight including a mounting bracket for mounting the booklight on a support and an elongate first arm having a proximal end and a distal end, the proximal end being pivotally attached to the mounting bracket. The distal end of the elongate first arm has a substantially rectangular cross-section. A rigid elongate retractable arm has a proximal end and a distal end. The proximal end of the elongate retractable arm is telescopically connected to the distal end of the elongate first arm, and also has a substantially rectangular cross-section. The elongate retractable arm is mounted for movement with respect to the elongate first arm between a retracted position and an extended position and a light-radiating source is mounted at the distal end of the elongate retractable arm.

In addition, the present invention relates to a booklight including a mounting bracket for detachably mounting the booklight on a support and a first arm having a proximal end and a distal end, the proximal end being pivotally attached to the mounting bracket. A rigid second arm has a proximal end and a distal end, the proximal end of the second arm being telescopically mounted to the distal end of the first arm. The second arm is mounted for movement with respect to the first arm between a retracted position and an extended position. A light-radiating source is connected at a distal end of the second arm and a switch turns the light-radiating source on to radiate light in response to movement of the second arm to the extended position and switches the light-radiating source off so as to not radiate light in response to movement of the second arm to the retracted position. The mounting brackets for the booklights can be in the form of a clip for clipping the booklight to a book, for example, or a clamp for clamping the booklight to a personal computer, for example.

BRIEF DESCRIPTION OF THE DRAWINGS

A better understanding of the objects, features and advantages of the invention can be gained from a consideration of the following detailed description of the preferred embodiments thereof, in conjunction with the appended figures of the drawings, wherein a given reference character always refers to the same or like element or part and wherein.

DETAILED DESCRIPTION OF THE PREFERRED EMBODIMENTS

Figure 1:
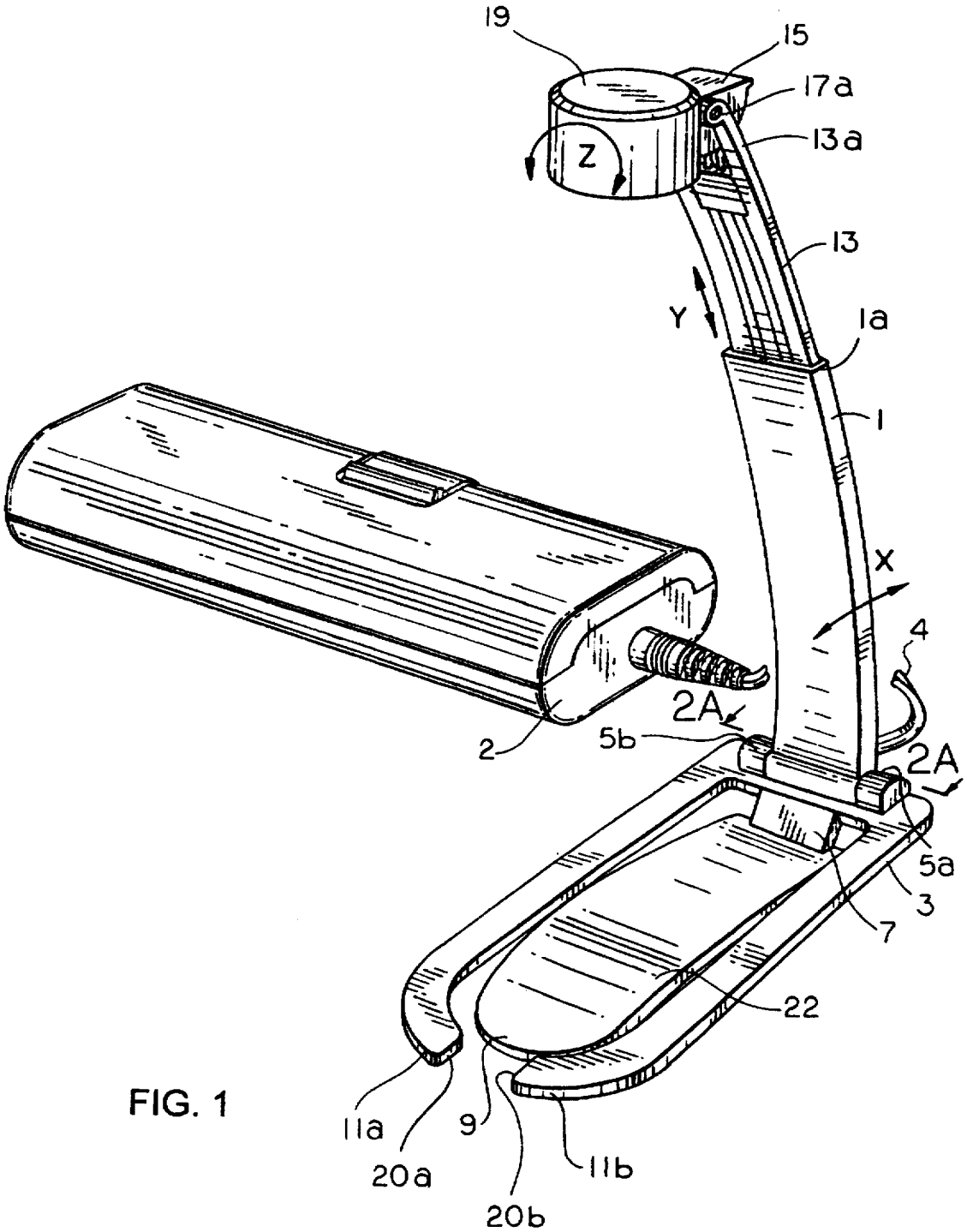
FIG. 1 is a perspective view of a telescoping booklight according to a first embodiment of the present invention.

Referring now to FIG. 1, in which like reference numerals indicate like or similar elements, a booklight constructed according to an embodiment of the present invention includes elongate first arm 1 pivotally attached to mounting bracket 3. Elongate retractable arm 13 is telescopically connected to elongate first arm 1. A light-radiating source 15 is pivotally mounted to elongate retractable arm 13. A power source such as power pack 2, the construction of which is well known in the art, is provided for storing a battery or batteries for powering light-radiating source 15, via power cord 4. The batteries can consist of any suitable type of rechargeable or disposable cell.

Figure 3:
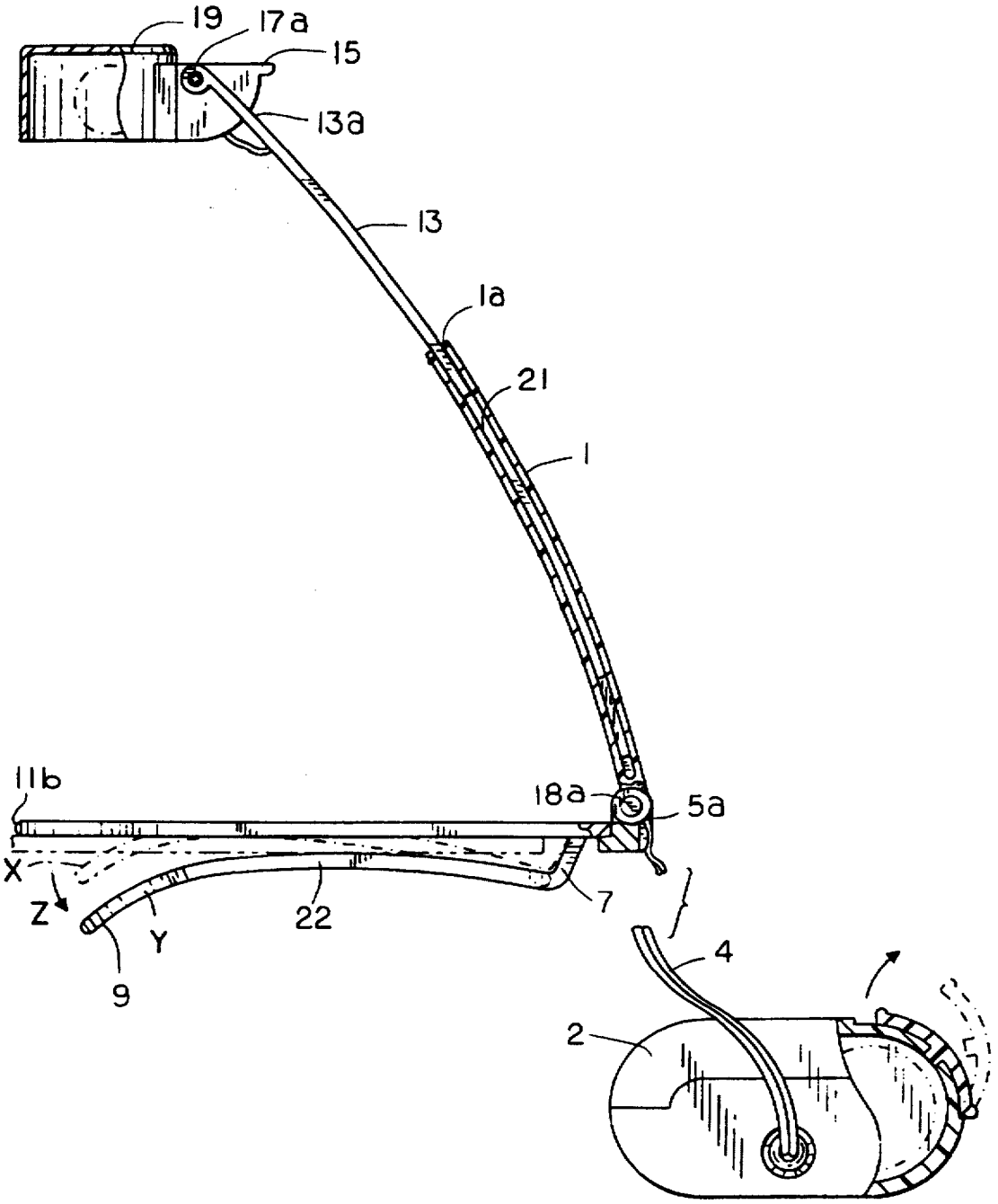
FIG. 3 is a partial cross sectional side view of the telescoping booklight according to the first embodiment of the present invention.

Mounting bracket 3 can be attached to a book, magazine or the like for supporting the booklight. Mounting bracket 3 includes plate 9, connecting member 7, projections **11*a* and 11*b* and a mounting block consisting of hinge receptacles 5*a* and 5*b*. Preferably, but not necessarily, projections 11*a* and 11*b* are not attached to each other at their distal ends 20*a* and 20*b*, respectively, for reasons which will become apparent in the detailed description below. Hinge receptacles 5*a* and 5*b* and projections 11*a* and 11*b* are a rigid construction which may be integrally molded as one piece of appropriate plastic. Plate 9 is flexibly attached to mounting bracket 3 via connecting member 7 and is formed with a raised bow portion 22. As shown more clearly in FIG. 3, in its normal position X, shown by dashed lines, raised bow portion 22 of plate 9 may extend even with projections 11*a* and 11*b*. Plate 9 is flexible and is movable in the direction indicated by arrow Z to open position Y. The dimensions of projections 11*a* and 11*b* and plate 9** are such that they provide a sufficient gripping surface to clamp between them a number of pages of a book and/or book cover, for example, so that the booklight in essence becomes self-supporting upon the object to which light is directed.

Figure 2A:
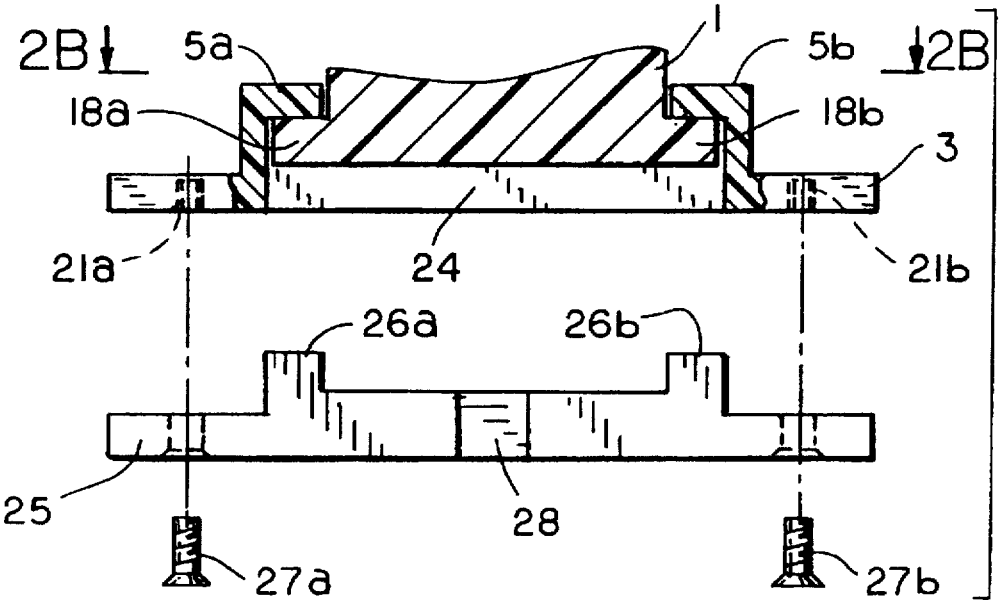
FIGS. 2A and 2B are partial cross sectional views of the telescoping booklight depicted in FIG. 1.
Figure 2B:
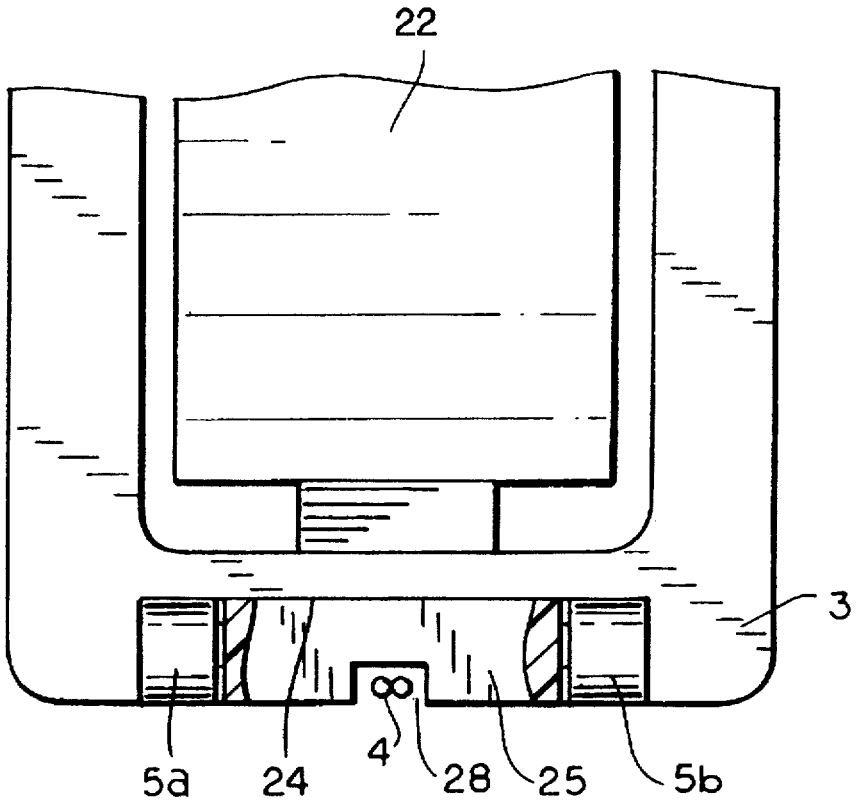

As shown in FIGS. 2A and 2B, elongate first arm 1 extends upwardly from mounting bracket 3, and is mounted to pivot in transverse slot 24. More specifically, transverse slot 24 is provided between hinge receptacles **5*a* and 5*b* which receive pivot pins 18*a* and 18*b*, respectively, of elongate first arm 1. Pivot pins 18*a* and 18*b* are preferably, but not necessarily, integrally formed with elongate first arm 1. Hinge receptacles 5*a* and 5*b* act as a portion of a bearing surface for pivot pins 18*a* and 18*b*. Bearing plate 25 provides the other portion of the bearing surface for pivot pins 18*a* and 18*b*. More particularly, bearing plate 25 includes bearing arm extensions 26*a* and 26*b* which, when bearing plate 25 is secured to mounting bracket 3 with screws 27*a* and 27*b* act as the other portion of the bearing surface for pivot pins 18*a* and 18*b* of elongate first arm 1. Bearing plate 25 includes a notched portion 28 which, when elongate first arm 1 is in the position shown in FIG. 1, receives power cord 4 extending from elongate first arm 1. When in this position, power cord 4 acts as a stop for preventing elongate first arm 1 from over pivoting. Of course, additional fixed stops (not shown) can be provided on elongate first arm 1** for also preventing it from over pivoting.

Bearing plate 25 is attached to mounting bracket 3 on either side of the bearings by screws **27*a* and 27*b*. It should be noted that threaded openings 21*a* and 21*b* in bracket 3 may be somewhat greater in depth than the length of the screws. This permits the screws to be tightened (or loosened) in an adjustable manner to vary pressure on pivot pins 18*a* and 18*b* through bearing arm extensions 26*a* and 26*b*. Accordingly, this arrangement allows sufficient pressure to be placed upon pivot pins 18*a* and 18*b* so that elongate first arm 1** can be moved at will by the user, but will remain set at any desired angular position.

Figures 4A, 4B:
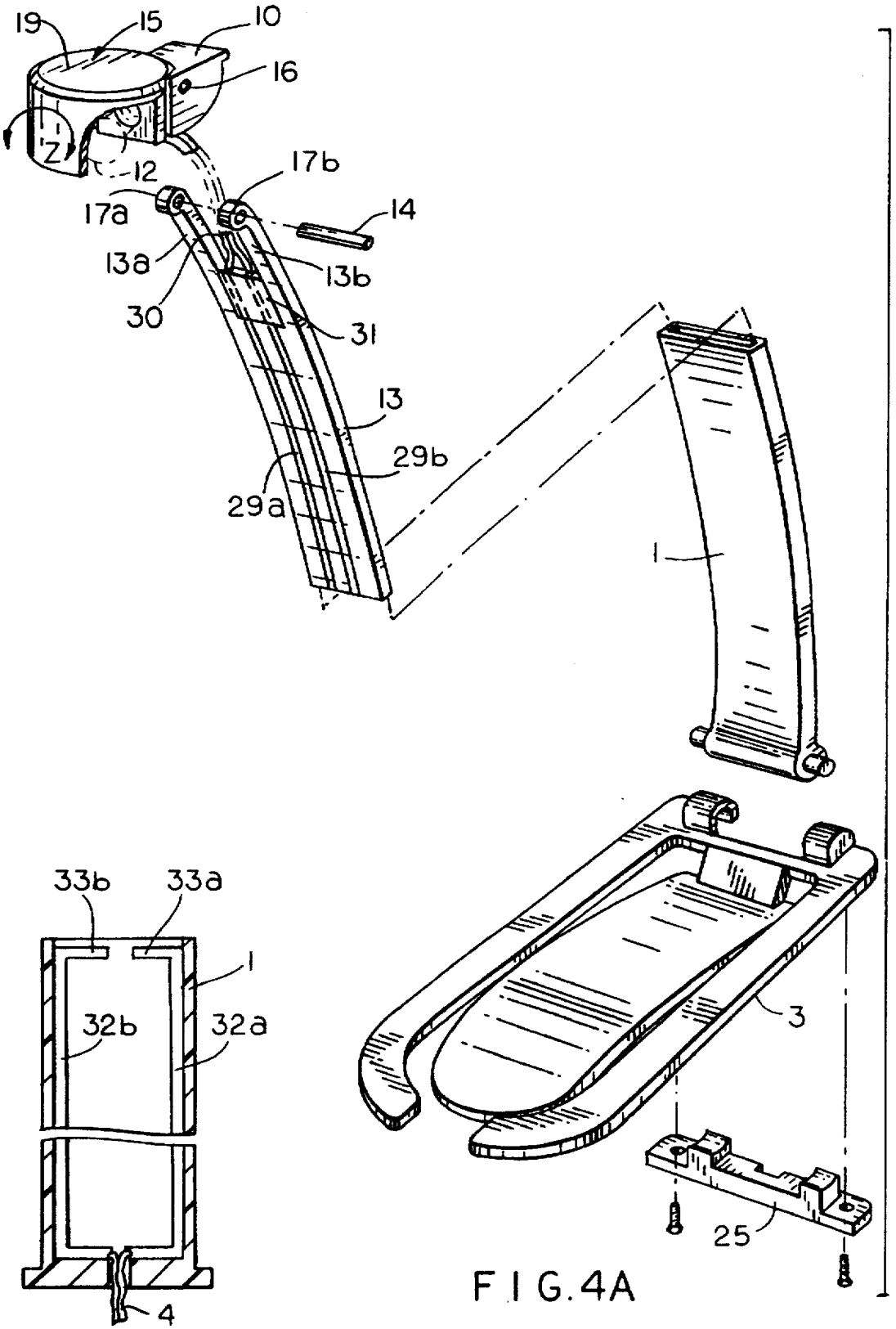
FIG. 4A is an exploded perspective view of a telescoping booklight according to the first embodiment of the present invention.
FIG. 4B is a cross sectional view of a telescoping arm used in the telescoping booklight according to the first embodiment of the present invention.

As shown more clearly in FIG. 4A, elongate first arm 1 consists of an elongate rigid tube, rectangular in cross section. Elongate first arm 1 is preferably, but not necessarily, provided with a slight curve, as shown. As shown in FIG. 4B, two conductive electrode strips 32*a* and 32*b* having tabbed portions 33*a* and 33*b*, respectively, are provided on the inside surface of elongate first arm 1. Two-wire cable 40 is electrically connected (e.g., soldered) to conductive electrode strips 32*a* and 32*b*. The other ends of cable 40 are electrically connected to power pack 2 in a known manner.

Elongate retractable arm 13 also has a rectangular cross sectional shape and is dimensioned to fit snugly into elongate first arm 1. Elongate retractable arm 13 is also rigid and has a slight curve corresponding to the slight curve in elongate first arm 1. As shown in FIG. 4A, two conductive electrode strips 29*a* and 29*b* are provided on the surface of elongate retractable arm 13 that abuts the inside surface of elongate first arm 1 having conductive electrode strips 32*a* and 32*b*. A second two-wire cable 30 is electrically connected (e.g., soldered) to conductive electrode strips 29*a* and 29*b*, as shown. The other ends of two-wire cable 30 are electrically connected to light-radiating source 15. A portion of exposed electrode strips 29*a* and 29*b* are covered by an electrical insulating material 31 such as a thin layer of plastic, for example.

Figure 5:
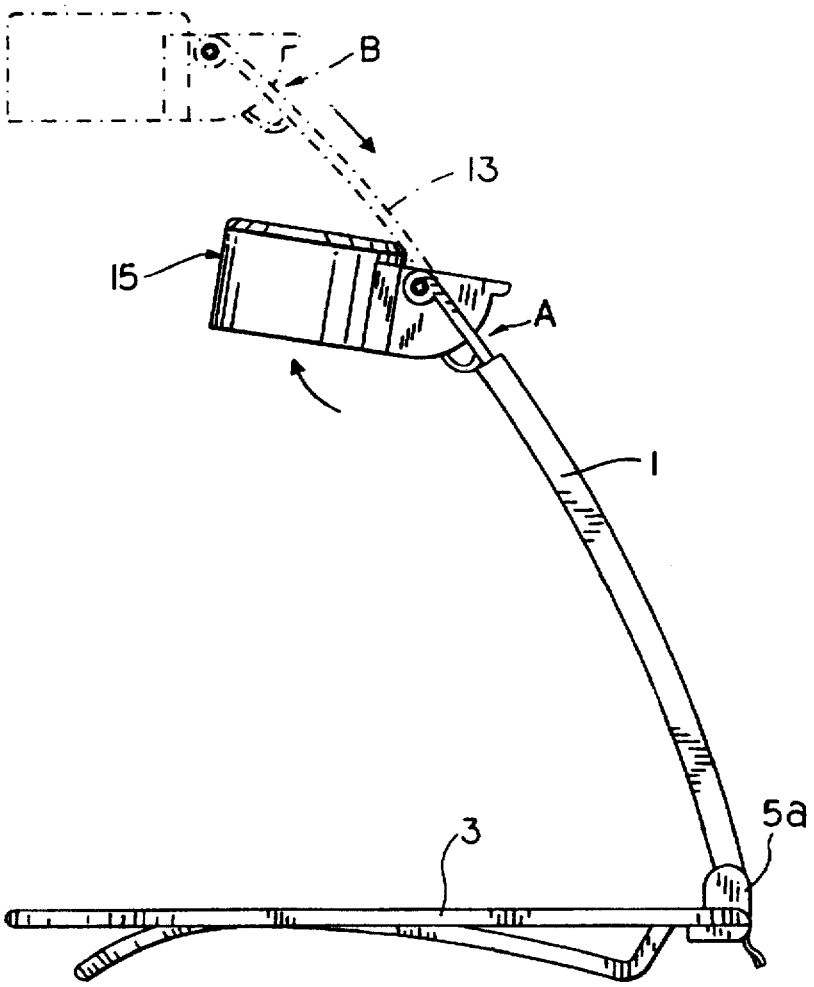
FIG. 5 is a side view of the booklight according to the first embodiment of the present invention.

A proximal end of elongate retractable arm 13 is telescopically connected to the distal end of elongate first arm 1. That is, as depicted in FIG. 5, elongate retractable arm 13 is slidably positioned within elongate first arm 1 for movement with respect thereto between a retracted position A and an extended position B. Since the telescopic union between elongate first arm 1 and elongate retractable arm 13 has a substantially rectangular shape, elongate retractable arm 13 is prevented from rotating with respect to elongate first arm 1. The dimensions of the telescopic union between elongate retractable arm 13 and elongate first arm 1 are provided so that elongate first arm 1 grips elongate retractable arm 13 snugly. Elongate retractable arm 13 can thus be easily retracted into and extended from elongate first arm 1, while allowing elongate retractable arm 13 to remain stationary at any desired position.

When elongate retractable arm 13 is in extended position B, electrode strips 29*a* and 29*b* are in electrical contact with tab portions 33*a* and 33*b* of electrical strips 32*a* and 32*b*, respectively. In this position, electrical continuity is formed between power pack 2 and light-radiating source 15, so that the light radiating source is energized and lights. When elongate retractable arm 13 is in retracted position A, insulating material 31 prevents electrical contact between electrode strips 29 and 29*b* and tabbed portions 33*a* and 33*b*, respectively, thus preventing electrical continuity between power source 2 and light radiating source 15 so that the light-radiating source is not energized.

A distal end of elongate retractable arm 13 includes two forklike projections 13*a* and 13*b*, as shown in FIG. 4A. Apertures 17*a* and 17*b* are provided at the distal ends of forklike projections 13*a* and 13*b*, respectively. Light-radiating source 15 is pivotally mounted between forklike projections 13*a* and 13*b*. More specifically, light-radiating source 15 includes main body portion 10 having aperture 16 extending therethrough. Main body portion 10 includes a light fixture (not shown) to which a light bulb 12 can be permanently or replaceably electrically connected. Aperture 16, when light-radiating source 15 is in proper position, is aligned with apertures 17*a* and 17*b* in forklike projections 13*a* and 13*b*. Pin 14 can be press fitted through aperture 16 in light-radiating source 15 and apertures 17*a* and 17*b* in forklike projections 13*a* and 13*b*, respectively, to provide a point about which light-radiating source 15 can pivot. Of course, other methods may be utilized for pivotally mounting light-radiating source 15. For example, screws can be placed through apertures 17*a* and 17*b* and secured in aperture 16 in light-radiating source 15. In any event, whatever the method used to secure light-radiating source 15 to elongate retractable arm 13, a snug firm fit should be provided allowing light-radiating source 15 to be pivoted by the user, while allowing it to remain at any desired angular position. Light radiating source 15 also includes a light hood 19 that is rotatably mounted to light radiating source 15 and can be rotated in the directions indicated by arrows Z. The inside surface of light hood 19 is, preferably, coated with a light reflective material such as, for example, a light reflective paint. By rotating light hood 19, a user can selectively direct light in a desired direction.

Accordingly, by providing a pivot about which light-radiating source 15 can move up and down, and by providing a light hood 19 rotatable left and right, light can be directed to virtually any position.

Figure 6:
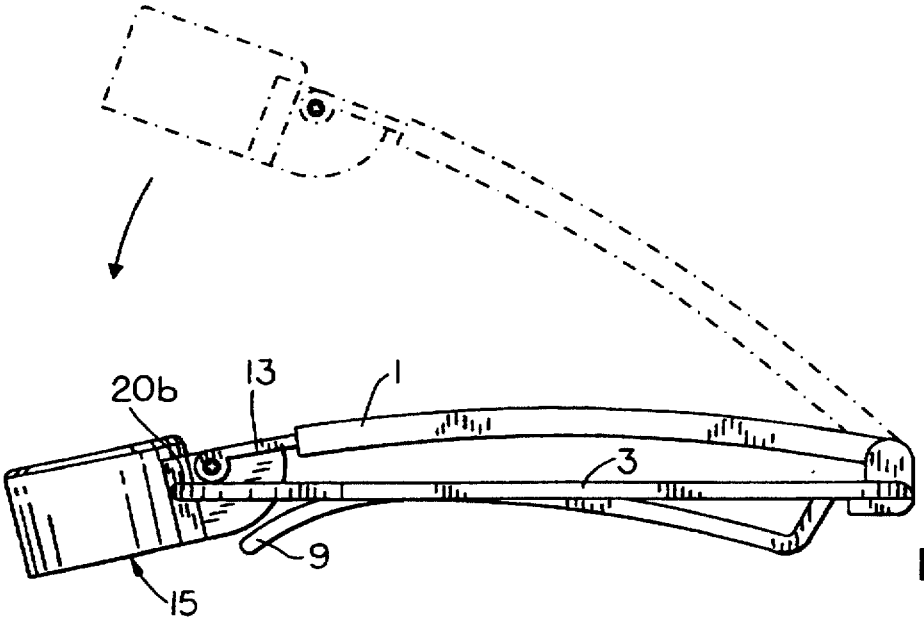
FIG. 6 is a side view of the booklight according to the first embodiment of the present invention, being placed in the folded position.

As shown in FIG. 6, the booklight can be folded down to a very compact size and can be fit into a pocket, for example. As shown, the gap between distal ends 20*a* and 20*b* of projections 11*a* and 11*b* allows the retracted arm to be folded so that main body portion 10 of light-radiating source 15 fits into the gap. This arrangement allows the device to be folded to a shape having a relatively flat profile, as shown.

Of course, it should be clear that the present invention is not limited to the use of two arms. That is, one or more additional retractable arms can be provided. For example, a second elongate retractable arm can be provided such that elongate retractable arm 13 retracts into the second elongate retractable arm which in turn, retracts into elongate first arm 1.

In addition, elongate first arm 1 and elongate retractable arm 13 can have cross-sectional shapes other than rectangular. For example, elongate first arm 1 and elongate retractable arm 13 can each be triangular or even oblong shaped in cross-section so as to prevent rotational movement of one with respect to the other when they are telescopically connected. In the alternative, interlocking channels can be provided on each of the arms enabling the arms to retract and extend in these channels instead of into the arms themselves.

In addition, although elongate retractable arm 13 is depicted in the figures as retracting into elongate first arm 1, the arms could, of course, be switched. That is, elongate first arm 1 could be designed to retract into elongate retractable arm 13.

Figure 7:
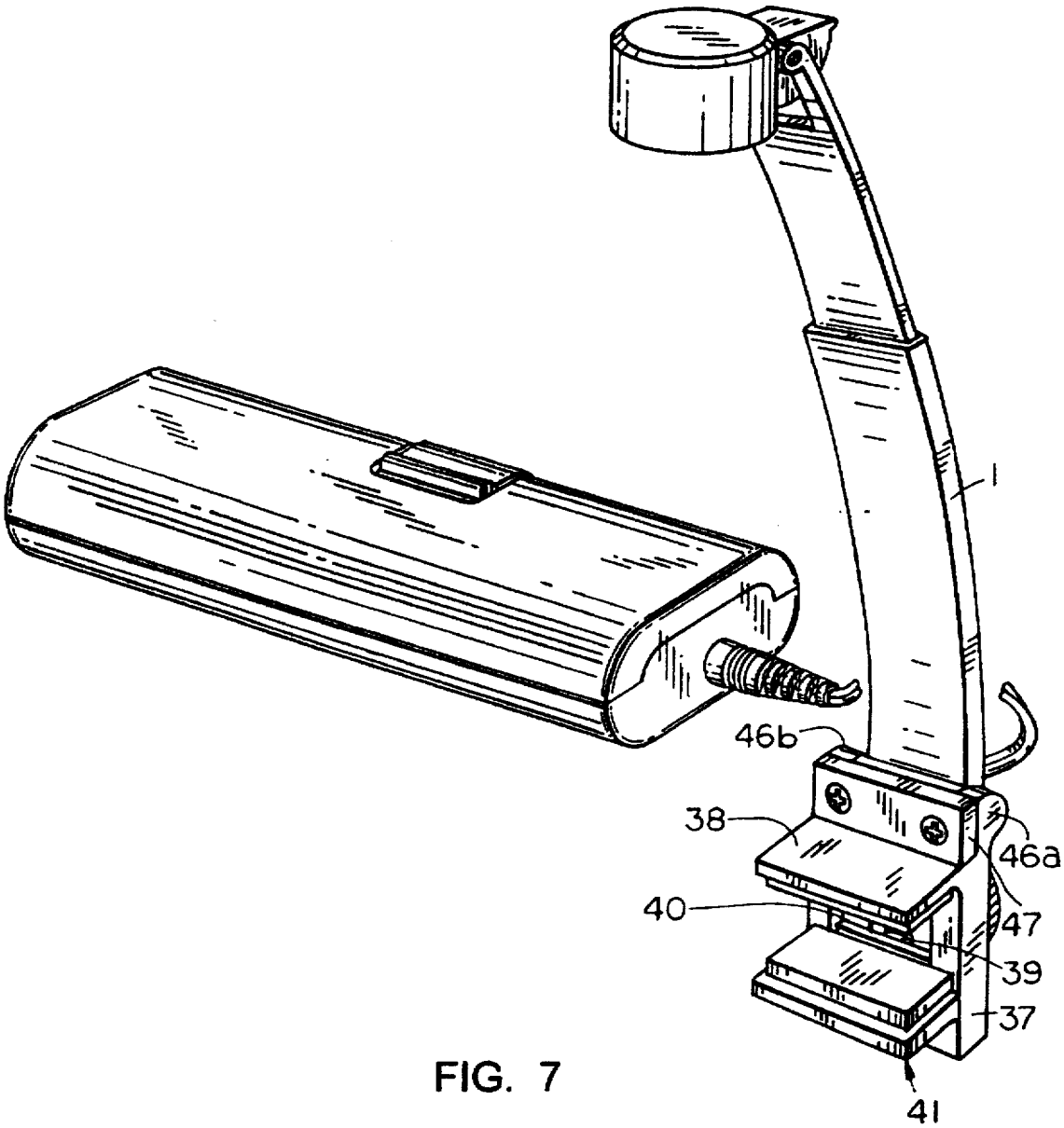
FIG. 7 is a perspective view of a telescoping light according to another embodiment of the present invention.
Figure 8:
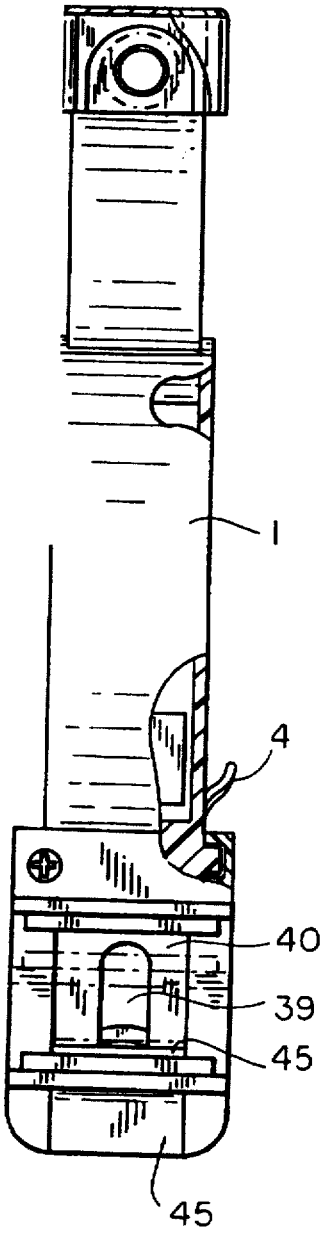
FIG. 8 is a partial sectional front view of the telescoping light depicted in FIG. 7.
Figure 9:
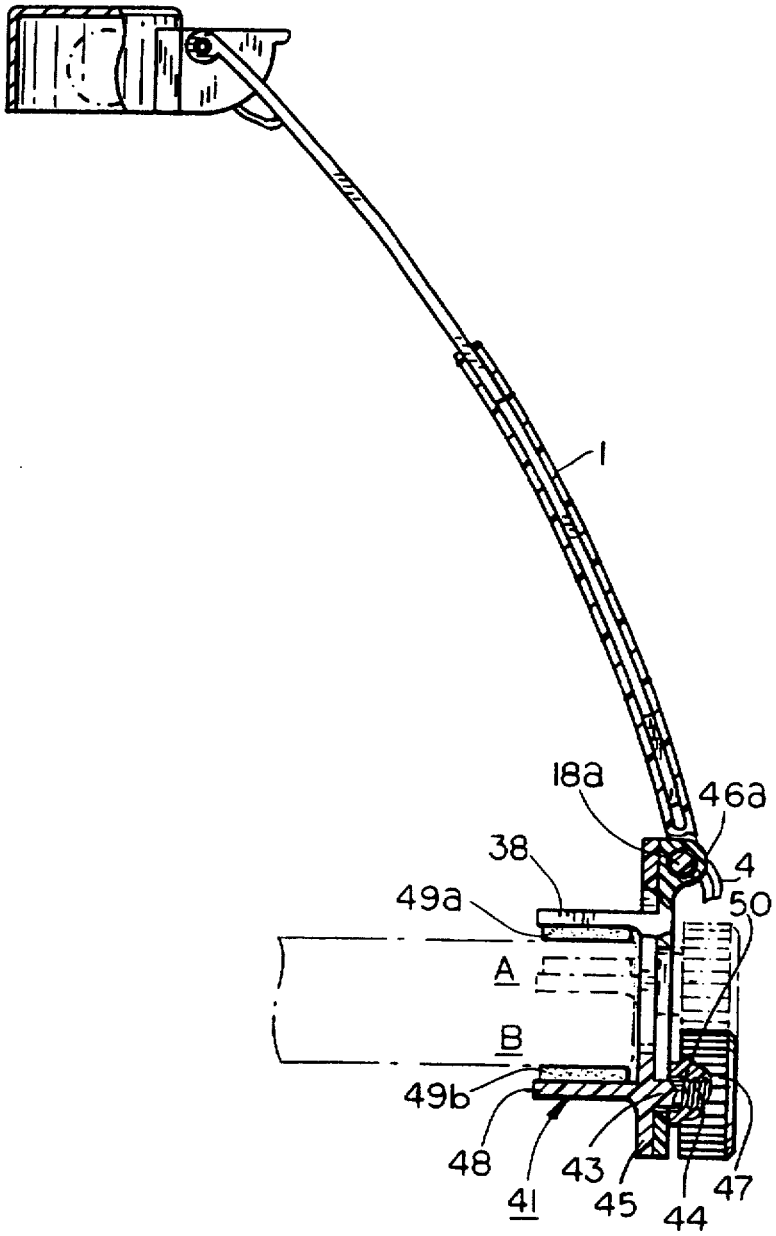
FIG. 9 is a cross sectional side view of the telescoping light depicted in FIG. 7.

Another embodiment of the present invention is shown in FIGS. 7—9. This embodiment is similar to the devices described above, but has a clamp-like mounting bracket 35 designed for mounting the booklight to a personal computer, for example.

As shown in FIGS. 7–9, mounting bracket 35 includes a mounting block consisting of hinge receptacles 46*a* and 46*b*, similar to hinge receptacles 5*a* and 5*b* depicted in FIG. 2A, which are integrally formed with main body 37. Bearing plate 47, similar to bearing plate 25 in FIG. 2A, is also provided. Elongate first arm 1 can thus be pivotally mounted to mounting bracket 35 via pivot pins 18*a* and 18*b* in a manner similar to that described above with respect to the first embodiment.

Main body 37 has fixed flange 38 extending at a right angle therefrom. As shown in FIGS. 7 and 8, main body 37 also includes a recessed grooved portion 40 having oblong aperture 39 provided therein. Adjustable arm member 41 is provided and can be selectively moved between position A and position B, as shown in FIG. 9. More specifically, adjustable arm member 41 includes a tabbed portion 45 dimensioned to fit within recessed grooved portion 40 of main body 37. Adjustable arm member 41 has a second flange 48 which extends at a right angle from a first side thereof. A guide pin 43, dimensioned to slidably fit within oblong aperture 39, extends from the other side of adjustable arm member 41 and includes threaded end portion 44. Knob 47 has a threaded center aperture 50 that can be screwed to threaded end portion 44. Knob 47 can be screwed down to threaded end portion 44 urging tabbed portion 45 against main body 37, thus fixing second flange 48 at any desired position. Knob 47 can be unscrewed, so that second flange 48 can be selectively moved toward or away from flange 38. Rubber pads 49*a* and 49*b* are provided on flanges 38 and 48, respectively, and protect the device (e.g., a personal computer) to which the booklight is clamped. Rubber pads 49*a* and 49*b* also provide a more positive grip for preventing mounting bracket 35 from slipping when clamped in position.

It will be understood that various modifications can be made to the embodiments of the present invention herein described without departing from the spirit thereof. The above description should not be construed as limiting the invention, but merely as exemplifications of preferred embodiments thereof. Those skilled in the art will envision other modifications within the scope and spirit of the present invention as defined by the claims appended hereto.

What is claimed is:

1. A booklight comprising:

a mounting bracket for mounting the booklight on a support;

a rigid, curved, elongate first arm having a proximal end and a distal end, the proximal end being pivotally attached to the mounting bracket;

a rigid, curved, elongate retractable arm having a proximal end and a distal end, the proximal end of the elongate retractable arm being telescopically connected to the distal end of the elongate first arm, the elongate first arm and elongate retractable arm being shaped so as to prevent rotation of the elongate retractable arm relative to the elongate first arm, the elongate retractable arm being mounted for movement with respect to the elongate first arm between a retracted position and an extended position; and a light-radiating source mounted at the distal end of the elongate retractable arm.

2. A booklight as recited in claim 1, wherein the distal end of the elongate first arm has a substantially rectangular cross section.

3. A booklight as recited in claim 1, wherein the proximal end of the elongate retractable arm has a substantially rectangular cross section.

4. A booklight as recited in claim 1 further comprising a switch that turns the light-radiating source on to radiate light in response to movement of the elongate retractable arm to the extended position and turns off the light-radiating source so as to not radiate light in response to movement of the elongate retractable arm to the retracted position.

5. A booklight as recited in claim 1, wherein the elongate first arm and elongate retractable arm have electrical conductive strips provided on abutting surfaces thereof, for supplying power from a power source to the light-radiating source.

6. A booklight comprising:

a rigid, curved, elongate first arm having a proximal end and a distal end, the proximal end being pivotally attached to the mounting bracket and the distal end having a substantially rectangular cross-section;

a rigid, curved, elongate retractable arm having a proximal end and a distal end, the proximal end of the elongate retractable arm being telescopically connected to the distal end of the elongate first arm, the proximal end of the elongate retractable arm having a substantially rectangular cross-section, wherein the elongate retractable arm is mounted for movement with respect to the elongate first arm between a retracted position and a extended position; and a light-radiating source mounted at the distal end of the elongate retractable arm.

7. A booklight as recited in claim 6 wherein the light-radiating source is pivotally mounted at the distal end of the elongate retractable arm.

8. A booklight as recited in claim 7 further comprising a switch that turns the light-radiating source on to radiate light in response to movement of the elongate retractable arm to the extended position and turns off the light-radiating source so as to not radiate light in response to movement of the elongate retractable arm to the retracted position.

9. A booklight as recited in claim 6, further comprising a light hood for directing light emanating from the light-radiating source.

10. A booklight as recited in claim 9 wherein the light hood is mounted for rotation about the light-radiating source.

11. A booklight as recited in claim 9 wherein the light hood is removably mounted adjacent the light-radiating source.

12. A booklight comprising:

a mounting bracket for detachably mounting the booklight on a support;

a rigid, curved, first arm having a proximal end and a distal end, the proximal end being pivotally attached to the mounting bracket;

a rigid, curved, second arm having a proximal end and a distal end, the proximal end of the second arm being telescopically mounted to the distal end of the first arm, the second arm being mounted for movement with respect to the first arm between a retracted position and an extended position;

a light-radiating source connected at a distal end of the second arm; and a switch that turns the light-radiating source on to radiate light in response to movement of the second arm to the extended position and switches the light-radiating source off so as to not radiate light in response to movement of the second arm to the retracted position.

13. A booklight as recited in claim 12 wherein the mounting bracket comprises a clip.

14. A booklight as recited in claim 12 wherein the mounting bracket comprises a clamp.

* * * * *